US006029926A

United States Patent [19]

Kimura et al.

[11] Patent Number: 6,029,926

[45] Date of Patent: Feb. 29, 2000

[54] DYED-YARN WINDING METHOD

[75] Inventors: Hidetoshi Kimura, Kyoto; Yuji Todo, Nagaokakyo, both of Japan

[73] Assignee: Murata Kikai Kabushiki Kaisha, Kyoto, Japan

[21] Appl. No.: 09/066,901

[22] Filed: Apr. 28, 1998

[30] Foreign Application Priority Data

Apr. 30, 1997 [JP] Japan ..... 9-126305

[51] Int. Cl.[7] ..... B65H 54/00

[52] U.S. Cl. ..... 242/485.5; 242/470; 242/487.5; 28/294

[58] Field of Search ..... 242/485.5, 487.5, 242/470, 474.2; 28/294

[56] References Cited

U.S. PATENT DOCUMENTS 3,988,879 11/1976 Franzolini et al. ..... 242/485.5 X
4,315,607 2/1982 Felix ..... 242/485.5
4,447,955 5/1984 Stutz et al. ..... 242/487.5 X
4,703,900 11/1987 Noshi et al. ..... 242/487.5 X
5,499,772 3/1996 Maeda et al. ..... 242/470 X

FOREIGN PATENT DOCUMENTS 6-322622 11/1994 Japan .
9-67065 3/1997 Japan .

*Primary Examiner*—Michael R. Mansen
*Attorney, Agent, or Firm*—Armstrong, Westerman, Hattori, McLeland & Naughton

[57] ABSTRACT

The present invention relates to a dyed-yarn winding method wherein specified length control operates to wind a specified length of a dyed-yarn y without dyeing specks to a winding package Pw, and then cuts the dyed-yarn to remove a dyed-yarn having dyeing specks and remaining an a dyed-yarn supply package Ps. Since the specified length control prevents that part of a dyed-yarn that has dyeing specks from being wound to a winding package, an operation for removing such a part from the winding package can be omitted.

3 Claims, 4 Drawing Sheets

DYED-YARN WINDING METHOD

FIELD OF THE INVENTION

The present invention relates to a dyed-yarn winding method that by a winder, winds a dyed-yarn that is wound around a dyeing bobbin having a large number of through-holes formed on the circumferential surface to a package.

BACKGROUND OF THE INVENTION

A yarn that is wound around the dyeing bobbin is dyed by a dyeing liquid which is supplied from the inside of the bobbin and is passed through through-holes formed on the circumferential surface of the bobbin. The dyeing liquid, however, does not entirely reach an inner-most layer that is close to the circumferential surface of the dyeing bobbin, causing dyeing specks to appear in this layer. Conventionally, a specified amount of the yarn that corresponds to such a dyeing speck portion in the inner-most layer is removed by an operator from the outer-most layer of a package around which the dyed-yarn has been wound by a winder, or by reversely rotating the package on the winder while the yarn is sucked into a suction mouth.

Alternatively, the dyeing bobbin with a dyeing speck portion located in the inner-most layer is ejected from the winder with the dyeing speck portion left thereon instead of being wound to a package. The bobbin is then transferred to a preparation station, where this portion is cut using a cutter in a stripping device for stripping remaining yarn from the bobbin.

After the yarn is wound to a package by the winder, the operator removes a specified amount of the wound yarn that corresponds to the dyeing speck portion through a visual check, as described above, and a considerable amount of time and labor is required to remove this portion. In addition, when the package is reversely rotated while the yarn is sucked into the suction mouth in order to remove a specified amount of the yarn that corresponds to the dyeing speck portion, a yarn defect removal operation must be performed for even this waste part of the yarn, thereby increasing the amount of unnecessary operations and reducing the operational efficiency of the winder.

In addition, when the dyeing speck portion wound around the dyeing bobbin as its inner-most layer is left thereon instead of being wound to a package and is then cut by the cutter, a large amount of labor and time is required to remove the dyeing-speck portion, and the cutter may damage the dyeing bobbin.

It is an object of the present invention to provide a dyed-yarn winding method that can solve these problems and automate the removal of the dyeing speck portion.

SUMMARY OF THE INVENTION

To achieve the above mentioned object, a dyed-yarn winding method according to the present invention performs an operation wherein, when a yarn on a supply package is to be wound to a winding package, after the yarn is cut by specified length control before winding is completed, remaining yarn on the supply package is removed on the winder. The remaining yarn may be sucked and removed by a sucking member. The winder may include a cylindrical balloon control member for controlling a releasing balloon for an unwound dyed-yarn, and the suction force of the sucking member, and an air flow injected from an air injection nozzle provided in the balloon control member may help to remove the remaining yarn.

DETAILED DESCRIPTION OF THE PREFERRED EMBODIMENTS

Figure 1:
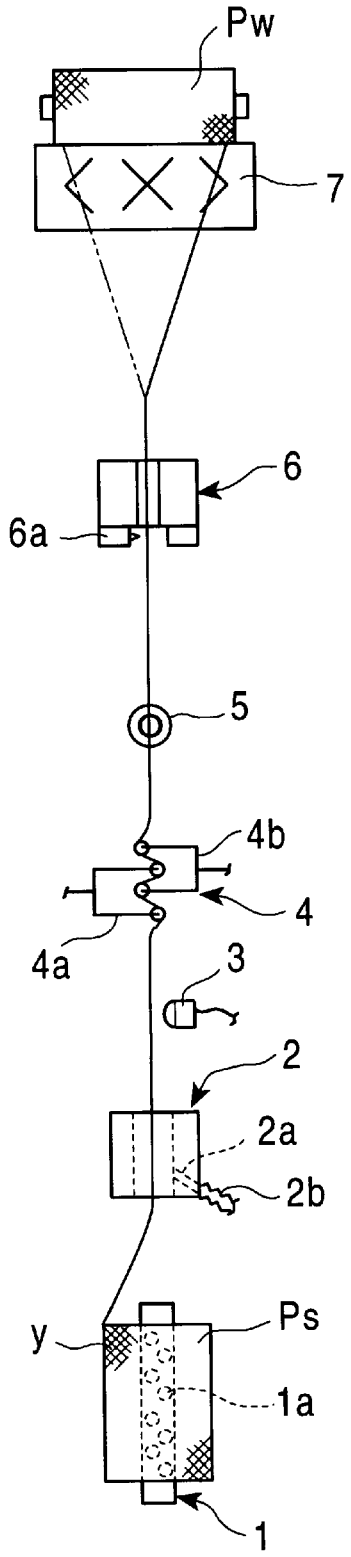
FIG. 1 is a schematic front view of a winder shown as an example in which a dyed-yarn winding method according to the present invention is implemented.

A dyed-yarn winding method according to the present invention is described with reference to FIGS. 1 to 4, which are schematic front views of a winder described as an example in which the present invention is implemented. The present invention, however, is not limited to the present embodiment provided its spirit is not deviated from.

1 is a dyeing bobbin having on its circumferential surface through-holes 1*a* through which a dyeing liquid passes, and a dyed-yarn y is wound around the dyeing bobbin 1. The dyeing bobbin 1 around which the dyed-yarn y is wound is also referred to as a dyed-yarn supply package Ps. 2 is a cylindrical balloon control member for controlling a balloon of the dyed-yarn y being unwound from the dyed-yarn supply package Ps, and an air injection nozzle 2*a* for generating an upward air flow is formed inside the balloon control member 2 and is connected to a compressed air source (not shown in the drawings) via a pipe 2*b*. 3 is a yarn detecting member composed of a photoelectric sensor for detecting the presence of the dyed-yarn y being unwound. 4 is a tension applying member composed of a gate tensor consisting of a pair of gates or a tension washer consisting of a pair of dish-like washers. The tension applying member 4 is configured so that a selection can be made between a tension applying position at which the pair of gates or washers sandwich the dyed-yarn y to apply tension to it and a standby position at which the pair of gates or washers leave each other instead of sandwiching the dyed-yarn y. According to the present embodiment, the tension applying member 4 is shown as a gate sensor consisting of a pair of gates 4*a* and 4*b* that can approach and move apart from each other.

5 is a suction port disposed near a travelling path for the dyed-yarn y. 6 is a slub catcher in which a cutter 6*a* is disposed. 7 is a traverse drum, and Pw is a winding package around which the dyed-yarn y from the dyed-yarn supply package Ps is wound, and which is configured to rotate when contacting the traverse drum being rotationally driven. Of course, the winding package Pw may be rotated by being contacted with a friction drum having no traverse grooves, while the dyed-yarn y may be traversed by a separately disposed traverse device.

Following the dyed-yarn supply package Ps, the balloon control member 2, yarn detecting member 3, tension applying member 4, suction member 5, and slub catcher 6 are disposed in this order in the travelling direction of the dyed-yarn y (upward in FIGS. 1 to 4).

FIG. 1 shows a steady state in which the dyed-yarn y wound around the dyed-yarn supply package Ps is being wound to the winding package Pw that rotates while contacting the traverse drum 7 via the balloon control member 2, yarn detecting member 3, tension applying member 4, suction member 5 and slub catcher 6. In this state, no air is injected from the air injection nozzle 2*a* formed in the balloon control member 2. A suction force that does not adversely affect the dyed-yarn y being wound constantly acts on the suction member 5. This embodiment shows a case of, what is called, cone to cone winding in which a single winding package Pw is formed from a single dyed-yarn supply package Ps, around which the dyed-yarn y is fully wound.

The fixed length of the dyed-yarn y is wound around the full dyed-yarn supply package Ps, and the length of that part of the dyed-yarn y, which has no dyeing specks and the length of the non-uniformly dyed portion in the inner-most layer are known. Therefore, by providing specified length control for the dyed-yarn y wound around the winding package Pw, that part of the dyed-yarn y in the inner-most layer that has dyeing specks can be prevented from being wound around the winding package Pw. The specified length control of the winding package Pw can be carried out by various methods, e.g., measuring the number of rotations of the traverse drum 7.

Figure 2:
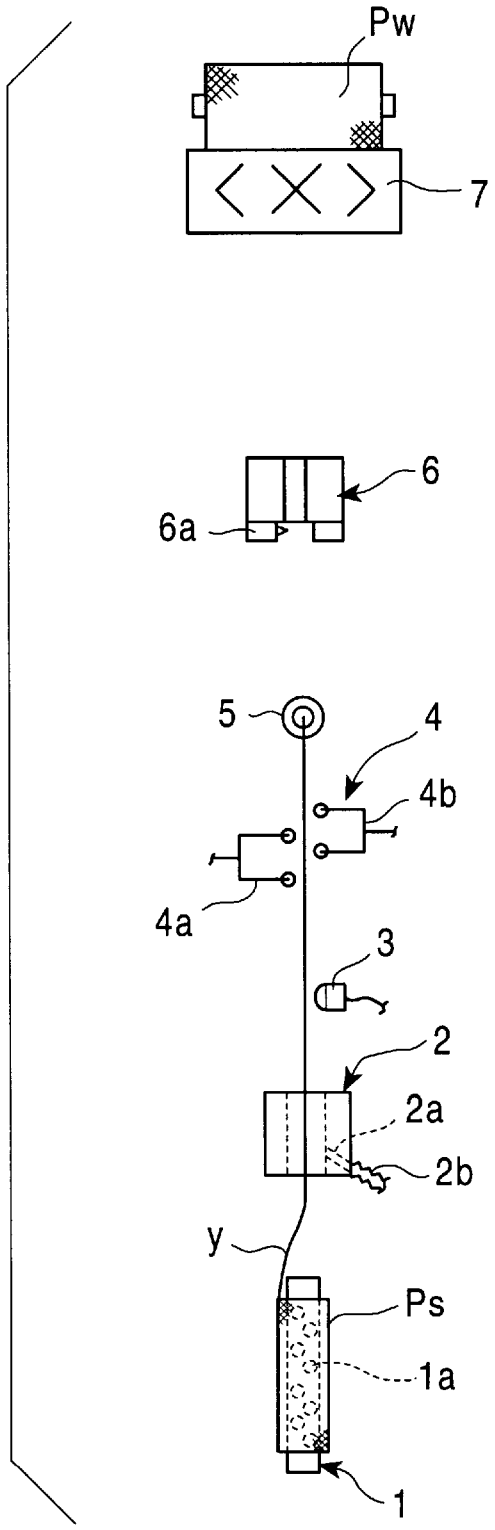
FIG. 2 is a schematic front view of a winder shown as an example in which a dyed-yarn winding method similar, at a different stage of operation to that in FIG. 1 is implemented.

If, for example, the number of rotations of the traverse drum 7 is measured to detect that only the specified length of the dyed-yarn y without dyeing specks has been wound to the winding package Pw, based on a signal from a rotation number counting means for the traverse drum 7, the cutter 6*a* in the slub catcher 6 is activated via a central processing unit (CPU) to cut the dyed-yarn y below the slub catcher 6. The dyed-yarn y, which has been cut by the cutter 6*a* in the slub catcher 6, is sucked by the suction member 5 as shown in FIG. 2. The dyed-yarn y with dyeing specks, which has been sucked by the suction member 5, is collected by a dust box connected to the suction member 5.

As described above, after the specified length of the uniformly dyed-yarn y has been wound to the winding package Pw based on the specified length control, the cutter 6*a* in the slub catcher 6 is activated to cut the dyed-yarn y and the cut dyed-yarn y is sucked by the suction member 5. When the yarn detecting member 3 confirms the presence of the dyed-yarn y, the gates 4*a* and 4*b* of the tension applying member 4 are then opened via the central processing unit (CPU) based on a signal from the yarn detecting member 3 indicating the presence of the dyed-yarn y, as shown in FIG. 2.

Figure 3:
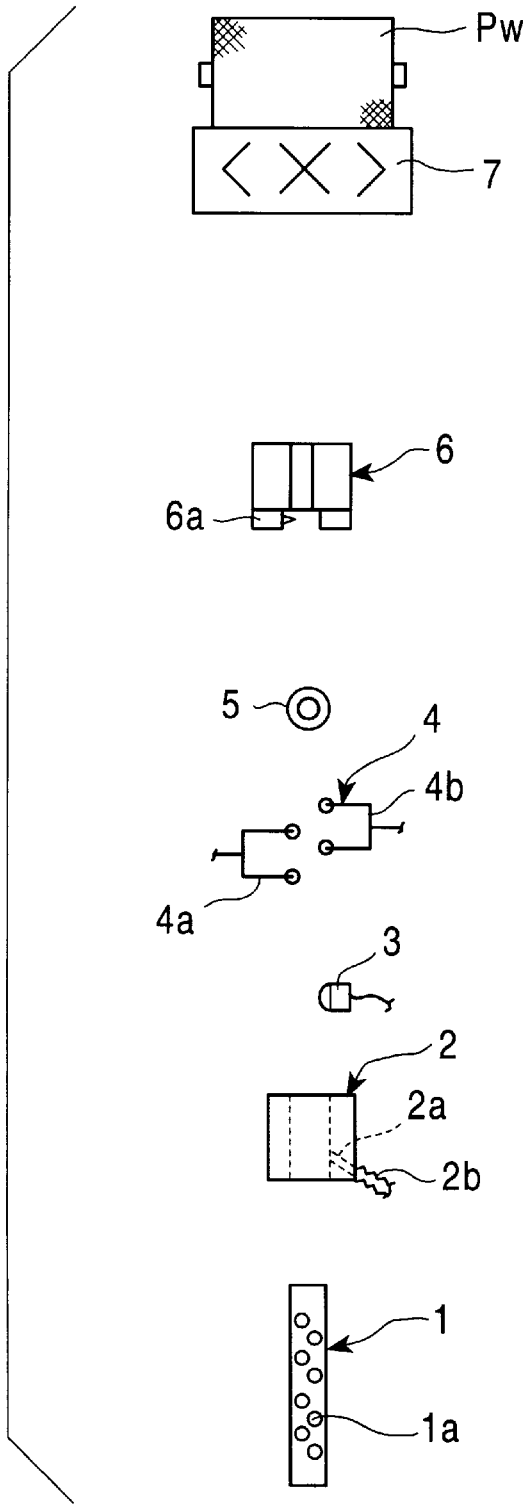
FIG. 3 is a schematic front view of a winder shown as an example in which a dyed-yarn winding method similar, at a further step of operation to that in FIG. 1 is implemented.

When the gates 4*a* and 4*b* of the tension applying member 4 are opened to release the tension applied by the tension applying member 4, that part of the dyed-yarn y that has dyeing specks and that is located in the inner-most layer of the dyeing bobbin 1 is sucked into the suction member 5 to remove, from the dyeing bobbin 1, that part of the dyed-yarn y that has dyeing specks, as shown in FIG. 3. If the suction force of the suction member 5 itself is insufficient to remove the dyed-yarn y having dyeing specks from the dyeing bobbin 1, air is injected from the air injection nozzle 2*a* formed in the balloon control member 2 to form an upward air flow in the balloon control member 2, and both the suction force of the suction member 5 and the air flow flowing upward through the balloon control member 2 are used to remove the dyed-yarn y having dyeing specks from the dyeing bobbin 1.

Concurrently with the removal of that part of the dyed-yarn y that has the dyeing specks from the dyeing bobbin 1 described above, a well-known doffing device is used to remove the winding package Pw from a bobbin holding device (not shown in the drawings) and to allow the empty bobbin 8 (FIG. 4) to be sandwiched by the bobbin holding device.

Figure 4:
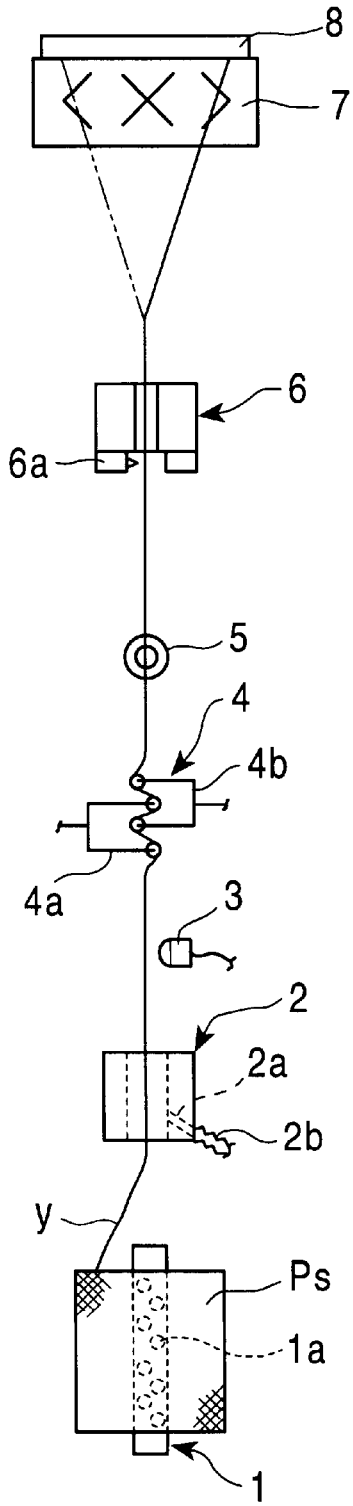
FIG. 4 is a schematic front view of a winder shown as an example in which a dyed-yarn winding method similar at a yet further step of operation to that in FIG. 1 is implemented.

Once all parts of the dyed-yarn y which have dyeing specks have been removed from the dyeing bobbin 1, the yarn detecting member 3 detects the absence of the dyed-yarn y. Based on this detection of the absence of the dyed-yarn y, a cop change device removes the dyeing bobbin 1 and provides a full dyed-yarn supply package Ps as well known in the art. Subsequently, the dyed-yarn y unwound from the dyed-yarn supply package Ps is passed through the balloon control member 2 and between the gates 4*a* and 4*b*, as shown in FIG. 4. The dyed-yarn y is further passed through the slub catcher 6 and is then engaged with the empty bobbin 8 or bobbin holding member (not shown in the drawings). Air is injected from the air injection nozzle 2*a* formed in the balloon control member 2 to form an upward air flow in the balloon control member 2 so that the dyed-yarn y can be passed through the balloon control member 2 using the air flow.

The gates 4*a* and 4*b* of the tension applying member 4 are then closed to apply tension to the dyed-yarn y, and the dyed-yarn y is wound around the empty bobbin 8 as is well known in the art. The tension applying member 4 can preferably be opened and closed by configuring one or both of the gates 4*a* and 4*b* of the tension applying member 4 so that they can move closer or apart from each other using an air cylinder.

Although the above embodiment has been described in conjunction with the case of cone to cone winding in which a single winding package Pw is formed from a single dyed-yarn supply package Ps around which the dyed-yarn y is fully wound, a single winding package Pw may be formed from a plurality of dyed-yarn supply package Ps. In this case, when the specified length control detects that the dyed-yarn y having no dyeing specks from a single dyed-yarn supply package Ps has been wound to the winding package Pw, the cutter 6*a* in the slub catcher 6 is activated to cut the dyed-yarn y and the cut dyed-yarn y is sucked into the suction member 5, as described above. Then, after that part of the dyed-yarn y which has dyeing specks has been removed from the dyeing bobbin 1, the cop change device removes the dyeing bobbin 1 and provides a new full dyed-yarn supply package Ps, as described above. Subsequently, as in a normal piecing operation, the dyed-yarn y drawn from the full dyed-yarn supply package Ps is introduced into a piecing device (not shown in the drawings) disposed adjacent to the slub catcher 6, and the end of that part of the dyed-yarn y that has no dyeing specks and that has been intertwined with the winding package Pw is sucked into the suction mouth, and the unwound dyed-yarn y is also introduced into the piecing device. Then, the dyed-yarn y drawn from the full dyed-yarn supply package Ps and the dyed-yarn unwound from the winding package Pw is pieced up by the piecing device, and winding is resumed to form a single winding package Pw from a plurality of dyed-yarn supply packages Ps.

Since the present invention has the above configuration, it can provide the following effects.

Since the specified length control prevents that part of the dyed-yarn that has dyeing specks from being wound to the winding package, the operation for removing the dyed-yarn having dyeing specks from the winding package can be omitted.

The present invention avoids the reverse rotation of the winding package on the winder to remove the dyed-yarn having dyeing specks from the winding package as in the conventional art, thereby preventing the operational efficiency of the winder from being reduced.

Since the specified length control prevents that part of the dyed-yarn that has dyeing specks from being wound to the winding package, the operation for removing such a part can be performed reliably and promptly compared to the manual removal of such yarns through a visual check.

Instead of manual operations, the suction member sucks and removes that part of the dyed-yarn that has dyeing specks, so the operation for removing such a part can be automated to facilitate the collection of such yarns.

That part of the dyed-yarn that has dyeing specks and that remains on the dyed-yarn supply package is removed using an air flow generated in the balloon control member by both the suction force of the suction member and air injected from the air injection nozzle formed in the balloon control member. Therefore, that part of the dyed-yarn that has dyeing specks and that remains on the dyed-yarn supply package can be removed reliably and promptly.

What is claimed is:

1. A dyed-yarn winding method comprising:

providing a dyed-yarn on a supply package for winding on a winding package on a winder;

winding the dyed yarn on said winding package;

cutting the dyed-yarn by a specific length control before said winding is complete; and removing remaining dyed-yarn on the supply package on said winder.

2. A dyed-yarn winding method as defined in claim 1, wherein said remaining dyed-yarn is removed by a sucking member.

3. A dyed-yarn winding method as defined in claim 2, wherein said winder includes a cylindrical balloon control member having an air injection nozzle;

injecting air from said air injection nozzle to pass dyed-yarn through said balloon control member; and sucking said dyed-yarn by said sucking member in cooperation with said injecting of air for removing said remaining yarn.

* * * * *